United States Patent [19]

Stockman

[11] 4,044,822

[45] Aug. 30, 1977

[54] HORIZONTAL MODULAR INTER-GASKET SEAL

[75] Inventor: Richard Franklin Stockman, Friendship, N.Y.

[73] Assignee: The Air Preheater Company, Inc., Wellsville, N.Y.

[21] Appl. No.: 647,533

[22] Filed: Jan. 8, 1976

[51] Int. Cl.[2] ..... F28D 19/00

[52] U.S. Cl. ..... 165/9; 277/81 R; 277/95; 277/96

[58] Field of Search ..... 165/9; 285/134, DIG. 18, 285/272; 277/81 R, 95, 96

[56] References Cited

U.S. PATENT DOCUMENTS

| | | | |
|---|---|---|---|
| 3,301,317 | 1/1967 | Weaving et al. | 165/9 X |
| 3,692,097 | 9/1972 | Penny | 165/9 |
| 3,743,008 | 7/1973 | Zeek et al. | 165/9 |
| 3,818,978 | 6/1974 | Finnemore | 165/9 |
| 3,907,310 | 9/1975 | Dufour | 165/9 X |
| 3,954,135 | 5/1976 | Hewlitt | 165/9 |

*Primary Examiner*—Ronald H. Lazarus
*Assistant Examiner*—Sheldon Richter
*Attorney, Agent, or Firm*—Wayne H. Lang

[57] ABSTRACT

Rotary regenerative heat exchange apparatus having a horizontal rotor post about which there are secured a plurality of axially spaced layers of heat absorbent element through which a heating fluid and a fluid to be heated are alternately directed. The heating element is contained in a plurality of sector-shaped compartments in juxtaposed relation that are pivotally attached to the rotor post. Sealing means are designed to be inserted as radial strips that extend between adjacent compartments in frictional engagement therewith to preclude the flow of fluid through the space therebetween. The sealing means are independent from the rotor structure at all times to permit complete freedom of movement whereby the sealing means will find an optimum relationship intermediate the element compartments.

6 Claims, 3 Drawing Figures

HORIZONTAL MODULAR INTER-GASKET SEAL

BACKGROUND OF THE INVENTION

This invention relates to rotary regenerative heat exchange apparatus in which a mass of heat absorbent material commonly comprised of packed element plates is positioned in a passageway to absorb heat from hot gases passing therethrough. After the plates become heated by the hot gas they are moved into a cool air passageway where the heated plates transmit their absorbed heat to the cool air flowing therethrough. The heat absorbent element is carried in adjacent compartments that comprise an annular layer around the rotor post, while a plurality of axially spaced layers of element with a sealing arrangement therebetween comprise a rotor having a predetermined heat absorbing capacity.

SUMMARY OF THE INVENTION

In accordance with this invention, I provide an arrangement whereby a mass of heat absorbent element is carried in open-ended compartments that are pivotally supported in laterally spaced relation outward from a central rotor post. Laterally adjacent compartments thus comprise an annular layer of element, while axially spaced layers of element together comprise the rotor of a complete heat exchanger. Fluid flow laterally between adjacent compartments is precluded by the use of floating sealing leaves that bridge the space between adjacent compartments. The sealing leaves are provided with lateral supports that freely ride between adjacent compartments to permit the seal to be inserted or withdrawn at any time. Inasmuch as the sealing leaves are not secured to the walls of the sectorial compartments they are free to move freely to find an optimum relationship between adjacent compartments.

Figure 1:
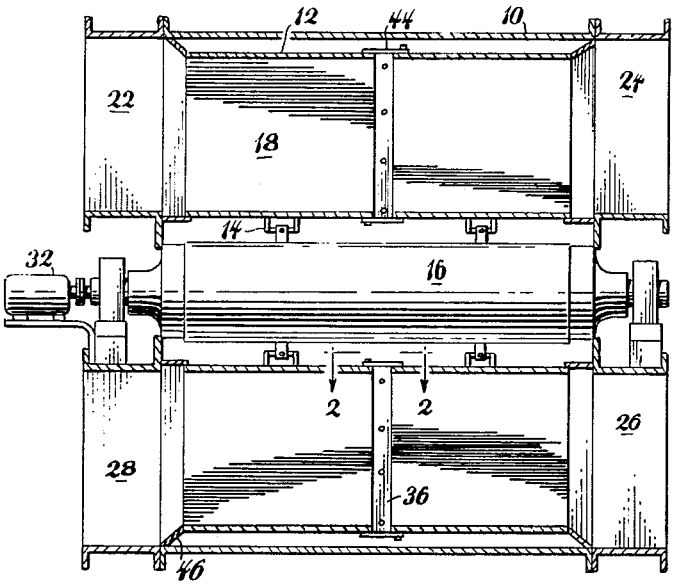
FIG. 1 is a cross-sectional view of a rotary regenerative heat exchanger having a rotor with a sealing arrangement in accordance with the present invention.
Figure 2:
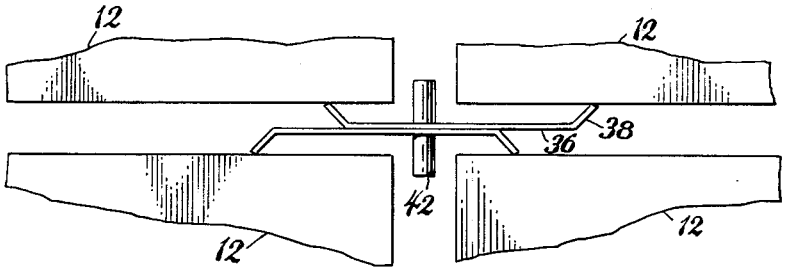
FIG. 2 is a perspective view of a modular rotor having sealing means as defined herein.
Figure 3:
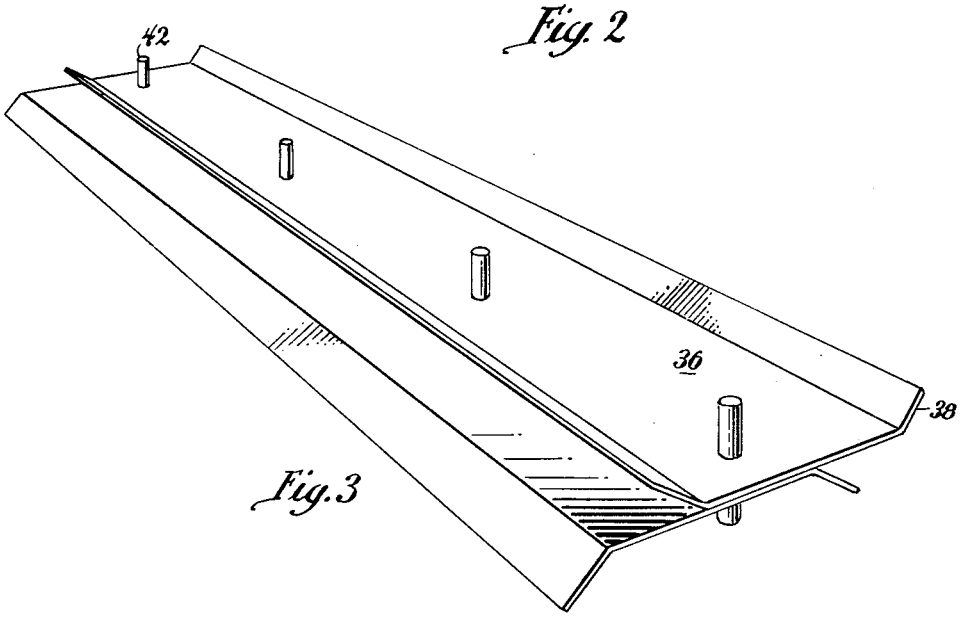
FIG. 3 is an enlarged perspective view of a floating sealing means used in apparatus of the invention.

The invention generally defines a housing 10 that encloses a rotor comprised of a plurality of open-ended, sector-shaped compartments 12 that are attached by pivotal means 14 to a central rotor post 16 to form a composite rotor that extends around the rotor post. The rotor compartments are filled with a mass of heat absorbent element, and two or more layers are usually combined to form a rotor of any predetermined heat absorbing capacity.

The element of the rotor is alternately contacted by a heating fluid and a cooler fluid to be heated in order that heat from the heating fluid is slowly given up to the fluid to be heated. To effect this transfer, heat absorbent element 18 is contacted by a stream of hot gas entering the housing 10 through an inlet duct 22 and being exhausted through an outlet duct 24 after having traversed the heat absorbent element therebetween. Cool air or other gas entering the housing through an inlet duct 26 is also exhausted to an outlet duct 28 after having traversed the hot heat absorbent material. While the heating fluid and the fluid to be heated are traversing the heat absorbent element of the rotor, the rotor is being slowly and continuously rotated about its axis by a drive motor 32 so that the entire rotor will be alternately contacted by the heating fluid and the fluid to be heated.

The heat absorbent material 18 of the rotor comprises what is essentially a mass of metallic plates formed to provide fluid passageways through which the heating fluid and the fluid to be heated alternately flow.

Inasmuch as the rotor comprises two or more layers of element with a space therebetween, the space must be provided with a form of sealing means that precludes the leakage of fluid through said space and thus directs both fluids through the heat absorbent element of the rotor.

Accordingly, elongate sealing strip comprised of leaves 36 having substantially the same length as the radial dimension of each compartment are arranged in back-to-back juxtaposition between adjacent compartments.

The leaves 36 are bent outwardly along their longitudinal edges 38 to abut the lateral sides of adjacent compartments and thus bridge the space therebetween. Although not essential to operation of the device, the sealing leaves 36 are preferably offset laterally to increase their stiffness and thus provide an improved resistance to fluid flow between adjacent compartments.

To restrict the use of each sealing strip 36 to the space between axially spaced element layers, guide pins 42 are spaced periodically along the length of sealing strips 36 so that they extend normal thereto and lie between layers of element to provide a guide that permits the sealing strips to be easily inserted or withdrawn between axially spaced compartments. The guide pins 42 are less in diameter than the distance between axially spaced element layers whereby they will readily slide between compartments and may thus be inserted or withdrawn at any time.

An annular sealing member 44 comprised of a series of arcuate leaves lying in end-to-end abutment around the entire rotor extend axially to overlap an adjacent element layer to preclude fluid flow between element layers. Moreover, other seals between adjacent compartments and circumferential seals 46 around the end of the rotor rule against adjacent housing structure to preclude the excessive leakage of fluid therebetween.

In operation of the device, rotation of the rotor provides an almost continuous movement or shifting of each compartment 12 carried by the pivotal attaching means 14 which depends from the rotor post 16. As the compartments move, the spacing therebetween shifts in size and position, but the sealing means 36 remains free to adjust to any change in sealing requirements.

While a single form of my device has been described herein, it will be understood that the primary concept described herein may be applicable to other sizes, shapes and arrangements of apparatus employed for the stated purpose. It will be understood that various changes may be made in the details of construction without departing from the spirit of the invention.

I claim:

1. Rotary regenerative heat exchange apparatus having a horizontal rotor post, a plurality of circumferentially spaced open ended compartments carried by the rotor post to comprise a first annular element layer that extends around the rotor post, a second annular layer of element similar to said first layer and supported by the rotor post in axially spaced relation to provide an annular space therebetween, a mass of permeable heat absorbent material carried in the compartments of the rotor, housing means surrounding the rotor and including connecting plates at opposite ends thereof with openings for a heating fluid and a fluid to be heated, means for rotating the rotor about its axis to alternately align the heating element with the heating fluid and the fluid to be heated, and elongate sealing means extending radially through the space between annular compartment layers and having guide pins normal thereto that ride on the sides of laterally adjacent compartments.

2. Rotary regenerative heat exchange apparatus as defined in claim 1 wherein the pins have a diameter less than the axial spacing between annular layers of compartments whereby said sealing means may be moved radially with respect to the compartments while they preclude the flow of fluid therebetween.

3. Rotary regenerative heat exchange apparatus as defined in claim 1 wherein the elongate sealing means comprise imperforate strips that bridge the space between laterally adjacent compartments.

4. Rotary regenerative heat exchange apparatus as defined in claim 1 wherein the sealing means comprise a plurality of laterally abutting metallic strips longitudinally formed to extend outwardly along the distal edges thereof into contacting relation with the side walls of laterally adjacent compartments.

5. Rotary regenerative heat exchange apparatus as defined in claim 1 wherein the sealing means comprise a pair of U-shaped strips arranged in back-to-back relation with the end edges of said strips lying in contacting arrangement with adjacent side walls of said compartments.

6. Rotary regenerative heat exchange apparatus as defined in claim 5 wherein the side walls of said U-shaped strips are displaced less than 45° from the bight thereof.

* * * * *